United States Patent [19]

Clarke

[11] 4,081,969

[45] Apr. 4, 1978

[54] WALL CONSTRUCTIONS

[76] Inventor: William Leslie Clarke, 182 Queen Street, Westport, New Zealand

[21] Appl. No.: 729,140

[22] Filed: Oct. 4, 1976

[30] Foreign Application Priority Data

| | | |
|---|---|---|
| Oct. 9, 1975 | New Zealand | 178908 |
| Jan. 29, 1976 | South Africa | 0498 |

[51] Int. Cl.[2] ..... E02D 17/20

[52] U.S. Cl. ..... 61/39; 61/47

[58] Field of Search ..... 61/39, 47, 35, 4, 37

[56] References Cited

U.S. PATENT DOCUMENTS

| | | | |
|---|---|---|---|
| 1,297,960 | 3/1919 | Yourtee | 61/47 UX |
| 1,695,997 | 12/1928 | Evers et al. | 61/39 X |
| 2,820,349 | 1/1958 | Cooper | 61/47 |
| 2,972,870 | 2/1961 | Cooper | 61/47 |
| 3,464,211 | 9/1969 | Andresen | 61/47 X |

FOREIGN PATENT DOCUMENTS

| | | | |
|---|---|---|---|
| 255,707 | 7/1926 | United Kingdom | 61/47 |

*Primary Examiner*—Dennis L. Taylor
*Attorney, Agent, or Firm*—Haseltine, Lake & Waters

[57] ABSTRACT

Earth retaining wall blocks including a plurality of similar header blocks and a plurality of similar stretcher blocks arranged for erection in tiered and interlocking relationship to present a generally flush frontal appearance. The header blocks are each elongate members arranged to extend from the front to the rear of the wall in generally parallel relationship and each have a front end portion with a groove or recess inset from the front face and in either the upper or lower surface of the front end portion, and a rear end portion adapted to engage with upper and lower surfaces of similar next tiered header blocks. Each stretcher block is an elongate member arranged to extend longitudinally of the erected wall between the front portions of adjacent tiered header blocks with the front faces of the header and stretcher blocks generally flush, and each stretcher block has a rear projection arranged to locate in the front end portion groove or recess of one of the adjacent tiered header blocks.

1 Claim, 3 Drawing Figures

WALL CONSTRUCTIONS

This invention relates to wall constructions and more particularly relates to building blocks including stretchers and headers intended for erection in tiered relationship in the construction of such as earth retaining walls.

An object of this invention is to provide improved constructions of header and stretcher blocks whereby the erected wall may present a generally flush frontal appearance.

Another object of the invention is to provide header and stretcher blocks for retaining walls and having interlocking means facilitating the erection of the walls and being arranged to prevent accidental displacement of the header and stretcher blocks relative to each other after erection of the wall.

Other objects and advantages of the invention will become apparent from the ensuing description.

According to this invention therefore there is provided a means for erecting a retaining wall comprising a plurality of similar header blocks and a plurality of similar stretcher blocks arranged to be erected in tiered relationship, the header blocks each being elongate members arranged for disposition from the front to the rear of the wall in generally parallel relationship and each having a front end portion with a groove or recess inset from the header block front face in either its upper surface or its lower surface and a rear end portion with upper and lower surfaces adapted to engage with lower and upper surfaces of similar next tiered header blocks, each stretcher block being an elongate member arranged for disposition longitudinally of the wall between the front end portions of adjacent tiered header blocks with the front faces of the stretcher and header blocks generally flush and having a rear projection arranged for location in the front end portion groove or recess of one of said adjacent tiered header blocks.

Figure 1:
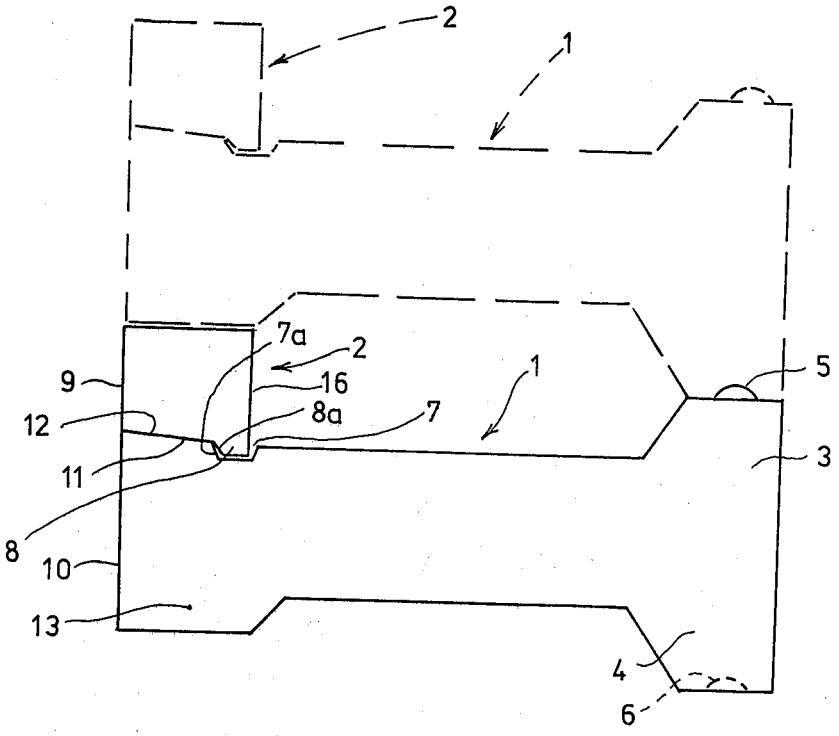
Figure 2:
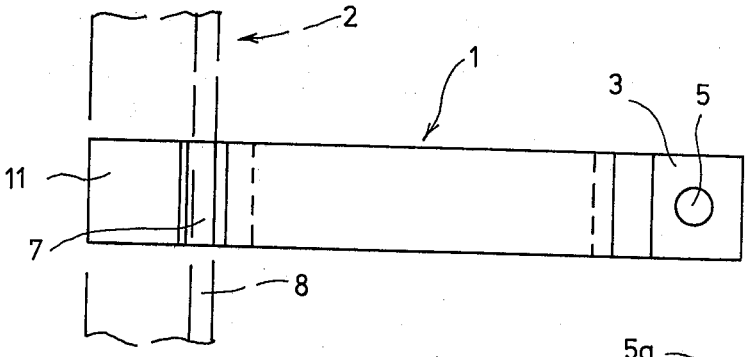
Figure 3:
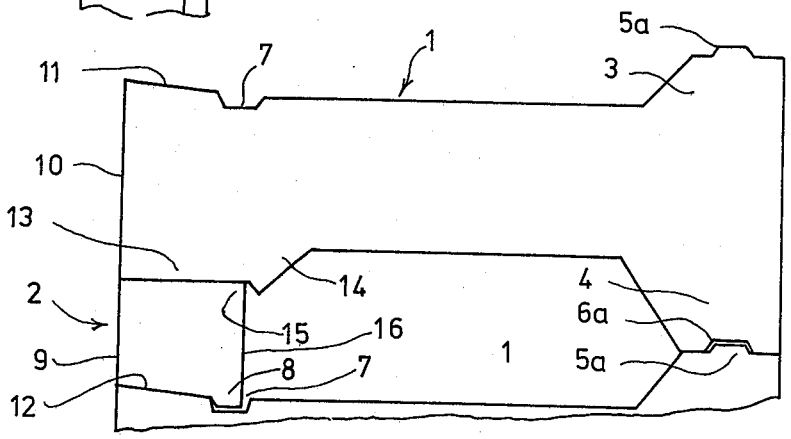

One preferred aspect of the invention will now be described by way of example with reference to the accompanying drawings, in which:

FIG 1 is a side elevational view of a header block and end or cross-sectional view of a stretcher block engaged with the header block, FIG. 2 is a plan view of the header block of FIG. 1, and FIG. 3 is a side elevational view illustrating modifications of the header block.

The header and stretcher blocks, (generally indicated by the arrows 1 and 2, respectively), in accordance with this invention are preferably precast in concrete material and may be provided with internal metal rod reinforcing, particularly for larger constructions of block. The header blocks 1 and associated stretcher blocks 2 are not limited to any one size but may be manufactured in small sizes such as for decorative land-scaping retaining walls in home gardens, or can be manufactured in a variety of larger sizes for the erection of larger retaining walls, such as may be required for motorway escarpments.

Each header block 1 in accordance with this invention is an elongate member the major part of which is of generally rectangular cross section, and the rear end part is of generally T formation (when viewed sideways) having upwardly and downwardly projecting flange portions 3 and 4, respectively, one of which may have (and as shown in FIGS. 1 and 2) a medial raised rounded projection 5 and the other of which may have a complementary medial recess 6 disposed in opposition so that the projection 5 of the one block 1 may engage in the recess 6 of an adjacent tiered block 1. In the illustrated form of the invention, according to FIGS. 1 and 2, the projection 5 is provided on the upper flange 3 and the recess provided on or in the lower flange 4, although the arrangement can be reversed. As an alternative to the provision of a rounded medial projection 5 and a complementary recess 6, and as shown by way of example in FIG. 3 of the drawings, it is envisaged that a rib 5*a* extending transversely of the block 1 for the full width thereof can be provided instead of the rounded projection or knob 5 and a complementary full width groove 6*a* provided on the other flange face in opposition to the rib 5*a* and instead of the medial recess 6.

The front end portion of the header block 1 is provided on its upper face with a full width transverse groove 7 inset from its front face and arranged to receive a portion of a depending longitudinal flange part 8 at the rear side of an elongate generally rectangular stretcher block 2, the width of the stretcher block 2 being complementary to the inset spacing of the groove 7 so that the front face 9 of the stretcher block 2 is arranged to lie flush with the front face 10 of the header block 1 in the erection of a wall. The transverse sides of the groove 7 in the header block front portion may be splayed outwardly and upwardly and similarly at least the forward face 8*a* of the depending longitudinal flange portion 8 of the stretcher block 2 may be inclined rearwardly, although it is envisaged that the front face 7*a*, of the groove 7 and front face 8*a* of the depending flange portion 8 can be substantially normal to the respective upper and lower faces of the header and stretcher blocks 1 and 2.

Preferably also the upper face 11 of the header block 1 between the groove 7 and front face 10 is inclined rearwardly and downwardly towards such groove 7 from the front face 10 and the lower face 11 of the stretcher block 2 has a complementary inclined formation.

The header blocks 1 are arranged to be erected in generally parallel tiered formation and thus, with the rear end flange portions 3 and 4 maintaining the header blocks 1 in spaced relationship the header block front end portion and stretcher block depth are of dimensions such that the parallel relationship is maintained. To reduce the overall cross sectional dimensions of the stretcher blocks 2 and thus result in a cost and weight saving, the front end portion of each header block 1 can be provided with a short depending flange portion 13 with a flat lower surface arranged to rest on the upper flat surface of a stretcher block 2 therebelow so that the header block medial part is waisted relative to its end parts.

With the interlocking arrangement of the header block rear end portions and the interlocking arrangement of the stretcher block depending flange portion 8 and header block transverse groove 7, coupled with the inclined mating faces 11 and 12 of the header and stretcher blocks 1 and 2 at the upper side of the header block front end portions, further interlocking between the header block front end lower side and the stretcher block upper side may not be necessary, but can be provided if so desired. It is envisaged for example that a lower formation of the header block front end portion can be similar to the upper formation with the transverse groove 7 and the stretcher block 2 may have an upper rear flange portion similar to the lower rear flange portion 8 for engagement therewith. Alternatively, and as shown by way of example in the arrangement according to FIG. 3 of the drawings, each header block depending flange portion 13 can have a lower rear part 14 extending its full width and arranged to project downwardly at the rear upper longitudinal edge portion 15 of the stretcher block 2 with which it is engaged to provide an abutment for such edge portion 15.

Thus it will be seen that by this invention there is provided an improved arrangement of header and stretcher blocks presenting a flush finish to the front of the erected wall and including interlocking arrangements between adjacent tiered header blocks and between the header blocks and front stretcher blocks in providing a strong retaining wall. Further, the provision of the depending flange 8 at the rear of each stretcher block 2 effectively increases the overall depth of the stretcher block 2 to thus provide a larger earth retaining surface 16 without providing unduly large cross section stretcher blocks 2.

It will also be seen that the header and stretcher blocks can be erected and be equally effective in an inverted arrangement to that described and illustrated.

Particular forms of the invention have been described and illustrated by way of example, but it will be appreciated that other variations of and modifications to the embodiments described and illustrated can take place without departing from the scope of the appended claims.

I claim:

1. A means for erecting a retaining wall comprising a plurality of similar header blocks and a plurality of similar stretcher blocks arranged to be erected in tiered relationship, the header blocks each being elongated members arranged for disposition from the front to the rear of the wall in generally parallel relationship and each having a front end portion with a groove or recess inset from the header block front face in its upper surface and a rear end portion with upper and lower surfaces adapted to engage with lower and upper surfaces of similar next tiered header blocks, each stretcher block being an elongated member arranged for disposition longitudinally of the wall between the front end portions of adjacent tiered header blocks with the front faces of the stretcher and header blocks generally flush and having a longitudinal flange-like rear projection arranged for location in the front end portion groove or recess of the lower one of said adjacent tiered header blocks, and the upper face part of each header block front end portion between its front end face and its inset groove or recess being inclined inwardly and downwardly towards said groove or recess and the mating lower longitudinal face of each stretcher block having a complementary inclined formation, each header block rear end portion being of substantially T formation having upwardly and downwardly projecting flange portions, one of said rear end portions having a medial raised projection and the other of said flange portions having a complementary medial recessed disposition in opposition so that the projection of one header block can engage the recess of an adjacent tiered similar header block, a face of each header block front end portion between its front end face and its inset recess being inclined inwardly towards said groove or recess and the mating face of each stretcher block having a complementary inclined formation, the front end portion of each header block having a depending flange portion with a flat lower surface arranged to rest on the upper flat surface of a stretcher block therebelow so that the medial part of the header block is waisted relative to its end portions, each header block front end portion having a further inset groove or recess similar to the first-mentioned inset groove or recess but on the opposite face of the front end portion, each stretcher block having a further complementary rear projection arranged for location in said further inset groove or recess of an adjacent tiered header block, each header block front end portion having a lower part projecting downwardly at the rear upper longitudinal edge portion of a stretcher block therebelow to provide an abutment for said longitudinal edge portion; the flange portion of said stretcher blocks increasing the effective rear face area of the stretcher blocks, the tapered cross-section of the stretcher blocks enabling molding of the stretcher blocks by removal of the stretcher blocks from a mold.

* * * * *